US011448475B1

(12) United States Patent
Laycock et al.

(10) Patent No.: US 11,448,475 B1
(45) Date of Patent: Sep. 20, 2022

(54) HAND OPERATED, MECHANICAL MAGAZINE LOADER, FOR AMMUNITION ON STRIPPER CLIPS

(71) Applicant: Trijent, LLC, Macy, IN (US)

(72) Inventors: Jordan Andrew Laycock, Indianapolis, IN (US); James Allen Laycock, II, Macy, IN (US); Jeron Adam Laycock, Peru, IN (US); Justin Charles Bryan, Columbus, IN (US)

(73) Assignee: Trijent, LLC, Macy, IN (US)

( * ) Notice: Subject to any disclaimer, the term of this patent is extended or adjusted under 35 U.S.C. 154(b) by 0 days.

(21) Appl. No.: 17/249,420

(22) Filed: Mar. 2, 2021

(51) Int. Cl.
*F41A 9/84* (2006.01)
*F41A 9/83* (2006.01)

(52) U.S. Cl.
CPC . *F41A 9/84* (2013.01); *F41A 9/83* (2013.01)

(58) Field of Classification Search
CPC ..... F41A 9/84; F41A 9/82; F41A 9/83
See application file for complete search history.

(56) References Cited

U.S. PATENT DOCUMENTS 2,856,720 A * 10/1958 Kunz ..... F41A 9/84 42/87
2,894,350 A * 7/1959 Stefan ..... F41A 9/84 42/87
6,754,987 B1 * 6/2004 Cheng ..... F41A 9/83 42/87
9,574,836 B1 * 2/2017 Cauley, Jr ..... F41A 9/83

FOREIGN PATENT DOCUMENTS

GB 274115 A * 5/1928 ..... F41A 9/83

OTHER PUBLICATIONS

Trijent Mech-Loader. <https://www.youtube.com/watch?v=cB9lzSIRIPM>. Sep. 7, 2020. (Year: 2020).*

* cited by examiner

*Primary Examiner* — Gabriel J. Klein
(74) *Attorney, Agent, or Firm* — Reichel Stohry Dean LLP; Mark C. Reichel; Natalie J. Dean

(57) ABSTRACT

This invention is generally related to the firearm/shooting and magazine loading industry. Many firearms are fed ammunition via a detachable magazine, which is generally a rectangular tube with an internal guide, operated by a spring. Ammunition is typically loaded from the top, one round at a time. Ammunition generally comes either loose, not contained in any grouping outside of the box, or on stripper clips, a small strip of metal that usually holds between five and ten rounds. This invention loads ammunition on stripper clips into magazines using mechanical leverage with a plunger (1) operated by a lever (2), travelling down rails (3), that pushes the rounds into the magazine. The stripper clip and magazine are held into place by their respective holders (4)(5).

18 Claims, 2 Drawing Sheets

HAND OPERATED, MECHANICAL MAGAZINE LOADER, FOR AMMUNITION ON STRIPPER CLIPS

TECHNICAL FIELD

This invention is generally related to the firearm/shooting and magazine loading industry.

BACKGROUND

Many firearms are fed ammunition via a detachable magazine, which is generally a rectangular tube with an internal guide, operated by a spring. Ammunition is loaded from the top, one round at a time. Ammunition generally comes either loose, not contained in any grouping outside of the box, or on stripper clips, a small strip of metal that typically holds between five and ten rounds. When loading magazines via stripper clips, a small metal loader is affixed to the top or back top of the magazine, the stripper clip with ammunition is pushed into the guide, then the rounds are driven into the magazine. This is done with physical force and lacks mechanical leverage.

BRIEF SUMMARY OF THE INVENTION

An object of the present invention is to provide a loader that uses mechanical leverage to load ammunition from a stripper clip into a detachable magazine for a firearm.

Provided a standard detachable magazine and ammunition on a stripper clip in a caliber that matches the detachable magazine, the present invention utilizes mechanical leverage to push the ammunition off of the stripper clip and into the magazine.

This is accomplished by placing ammunition on a stripper clip into the stripper clip holder then a detachable magazine into the magazine holder. The user then grabs the handle and pulls the handle forwards and upwards, which moves the plunger along the rails. The plunger will make contact with the ammunition and as force continues to be applied using the handle, the plunger pushes the ammunition into the magazine. The bottom and end of the magazine rests on the magazine support.

The rails are secured in the rail base and are free floating inside holes on the base plate. The levers and magazine holder are secured to the base plate. The rail base, magazine support, stripper clip holder, and the base plate are secured to the loader base.

After completion of one stroke, the handle is returned to the starting position. The now empty stripper clip is removed and is replaced with another until the magazine reaches the desired or maximum capacity. At that time the magazine is removed by depressing the magazine catch release, allowing the magazine to be removed and replaced with a new magazine.

DETAILED DESCRIPTION

Figure 1:
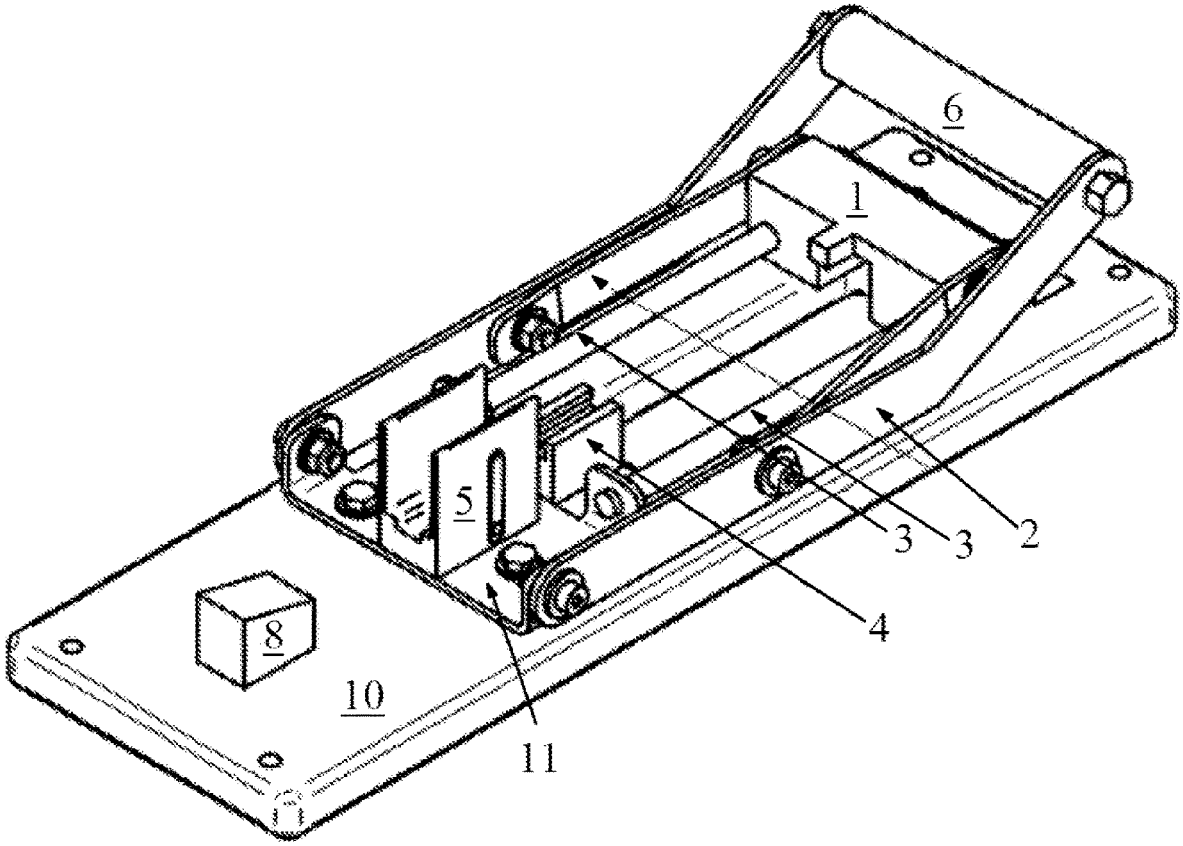
FIG. 1 depicts the loader from an angle top view with all operating components visible except (7), the magazine catch release, and (9), the rail base.
Figure 2:
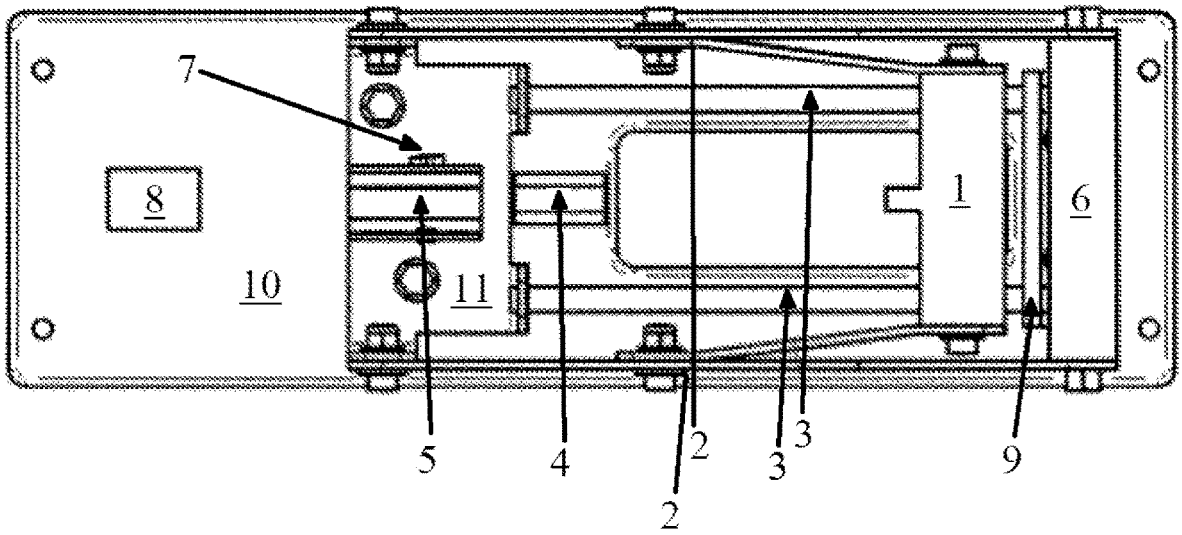
FIG. 2 depicts the loader from a top down view with all operating components visible.

An object of the present invention is to provide a loader that uses mechanical leverage to load ammunition from a stripper clip into a detachable magazine for a firearm.

Provided a standard detachable magazine and ammunition on a stripper clip in a caliber that matches the detachable magazine, the present invention utilizes mechanical leverage to push the ammunition off of the stripper clip and into the magazine.

This is accomplished by placing ammunition on a stripper clip into the stripper clip holder (4) then a detachable magazine into the magazine holder (5). The user then grabs the handle (6) and pulls the handle forwards and upwards, which moves the plunger (1) along the rails (3). The plunger will make contact with the ammunition and as force continues to be applied using the handle (6), the plunger (1) pushes the ammunition into the magazine. The bottom and end of the magazine rests on the magazine support (8).

The rails are secured in the rail base (9) and are free floating inside holes on the base plate (11). The levers (2) and magazine holder (5) are secured to the base plate (11). The rail base (9), magazine support (8), stripper clip holder (4), and the base plate (11) are secured to the loader base (10).

After completion of one stroke, the handle is returned to the starting position. The now empty stripper clip is removed and is replaced with another until the magazine reaches the desired or maximum capacity. At that time the magazine is removed by depressing the magazine catch release (7), allowing the magazine to be removed and replaced with a new magazine.

Exemplary ammunition loaders of the present disclosure can comprise a plunger (1), levers (2), rails (3), a stripper clip holder (4), a magazine holder (5), a handle (6), a magazine catch release (7), a magazine support (8), a rail base (9), a loader base (10), and/or a base plate (11).

The invention claimed is:

1. A loader for stripper clip ammunition, comprising:

a stripper clip holder configured to receive a stripper clip of ammunition;

a magazine holder configured to hold a detachable magazine;

a handle in mechanical communication with a plunger; and a pair of parallel rails extending through corresponding openings in the plunger, wherein the handle is configured to move in a direction causing the plunger to move along the parallel rails and to contact the stripper clip of ammunition, forcing ammunition of the stripper clip of ammunition into the detachable magazine using mechanical leverage.

2. The loader of claim 1, further comprising:

a magazine support configured to contact the detachable magazine while the plunger is used to force the ammunition of the stripper clip of ammunition into the detachable magazine.

3. The loader of claim 2, further comprising:

levers in communication with the handle, said levers configured to move when the handle is moved.

4. The loader of claim 3, further comprising:

a base plate coupled to the magazine holder; and a loader base coupled to the base plate.

5. The loader of claim 1, further comprising:

a base plate coupled to the magazine holder.

6. The loader of claim 5, wherein the parallel rails are secured within a rail base and are free-floating inside holes defined within the base plate.

7. The loader of claim 6, wherein the levers are secured to the base plate.

8. The loader of claim 5, further comprising:

a loader base coupled to the base plate; and a magazine support configured to contact the detachable magazine while the plunger is used to force the ammunition of the stripper clip of ammunition into the detachable magazine.

9. The loader of claim 8, wherein the parallel rails are secured within a rail base.

10. The loader of claim 9, wherein the rail base, the magazine support, the stripper clip holder, and the base plate are secured to the loader base.

11. The loader of claim 1, wherein when the stripper clip holder receives the stripper clip of ammunition and the magazine holder holds the detachable magazine, movement of the handle in a direction toward the magazine holder causes the ammunition of the stripper clip of ammunition to be loaded within the detachable magazine.

12. The loader of claim 11, wherein when the ammunition is loaded within the detachable magazine, movement of the handle back to a starting position allows an empty stripper clip to be removed from the loader, the empty stripper clip previously comprising ammunition of the stripper clip of ammunition.

13. A method, comprising:

providing a loader for stripper clip ammunition, having:

a stripper clip holder configured to receive a stripper clip of ammunition;

a magazine holder configured to hold a detachable magazine;

a handle in mechanical communication with a plunger; and a pair of parallel rails extending through corresponding openings in the plunger, wherein the handle is configured to move in a direction causing the plunger to move along the parallel rails and to contact the stripper clip of ammunition, forcing ammunition of the stripper clip of ammunition into the detachable magazine using mechanical leverage; and using the loader to load ammunition from the stripper clip of ammunition into the detachable magazine using mechanical leverage.

14. A method, comprising:

providing a loader for stripper clip ammunition, having:

a stripper clip holder configured to receive a stripper clip of ammunition;

a magazine holder configured to hold a detachable magazine;

a handle in mechanical communication with a plunger; and a pair of parallel rails extending through corresponding openings in the plunger, wherein the handle is configured to move in a direction causing the plunger to move along the parallel rails and to contact the stripper clip of ammunition, forcing ammunition of the stripper clip of ammunition into the detachable magazine using mechanical leverage; and positioning a stripper clip of ammunition within the stripper clip holder;

positioning a detachable magazine within the magazine holder configured to hold said detachable magazine; and engaging the handle in mechanical communication with the plunger to move the handle in a direction causing the plunger to move along the parallel rails of the loader and to contact the stripper clip of ammunition, forcing ammunition of the stripper clip of ammunition into the detachable magazine.

15. The method of claim 14, further comprising:

returning the handle to a starting position.

16. The method of claim 15, further comprising:

removing an empty stripper clip from the loader, the empty stripper clip previously comprising ammunition of the stripper clip of ammunition; and positioning a second stripper clip of ammunition within the stripper clip holder.

17. The method of claim 16, further comprising:

engaging the handle to move the handle in a direction causing the plunger to move along the parallel rails of the loader and to contact the second stripper clip of ammunition, forcing ammunition of the second stripper clip of ammunition into the detachable magazine.

18. The method of claim 17, further comprising:

returning the handle to a starting position;

removing a second empty stripper clip from the loader, the second empty stripper clip previously comprising ammunition of the second stripper clip of ammunition; and removing the detachable magazine from the loader.

* * * * *